US006863363B2

(12) United States Patent
Yabuta

(10) Patent No.: US 6,863,363 B2
(45) Date of Patent: Mar. 8, 2005

(54) MATERIAL SENSING METHOD AND APPARATUS DETERMINING MATERIAL TYPE BASED ON TEMPERATURE

(75) Inventor: Hisato Yabuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/437,921

(22) Filed: May 15, 2003

(65) Prior Publication Data

US 2003/0222935 A1 Dec. 4, 2003

(30) Foreign Application Priority Data

May 31, 2002 (JP) ..... 2002-159687

(51) Int. Cl.[7] ..... B41J 29/393
(52) U.S. Cl. ..... 347/19; 347/105; 347/106
(58) Field of Search ..... 347/19, 105, 17, 347/106; 374/43, 45

(56) References Cited

U.S. PATENT DOCUMENTS 5,255,149 A * 10/1993 Matsuo ..... 361/103
6,726,357 B2 * 4/2004 Luque et al. ..... 374/45

* cited by examiner

*Primary Examiner*—Stephen D. Meier
*Assistant Examiner*—Lam Nguyen
(74) *Attorney, Agent, or Firm*—Fitzpatrick, Cella, Harper & Scinto

(57) ABSTRACT

A material sensing apparatus detects the material (type) of an object, e.g., a recording medium, using a heat source which heats at least a portion of an object, a temperature sensor which measures the temperature of a portion of the object, a memory element which stores data on the relationship between temperature and type of object, and a determination element which determines the type of the object based on the measurement result of the temperature sensor and the data in the memory element. The temperature sensor measures the temperature of a portion of the object at a predetermined distance from the portion heated by the heat source.

2 Claims, 7 Drawing Sheets

MATERIAL SENSING METHOD AND APPARATUS DETERMINING MATERIAL TYPE BASED ON TEMPERATURE

BACKGROUND OF THE INVENTION

1. Field of the Invention

The present invention relates to a method and apparatus for sensing the material of an object.

2. Description of the Related Art

Currently, material sensing apparatuses for sensing materials of objects have been receiving attention in various technical fields. For example, in printers, the number of types of paper used has been increasing year by year, and there is a demand for apparatuses which sense the type of paper (e.g., OHP sheets, glossy paper for photographs, coated paper, or plain paper).

For example, in an ink-jet printer, with the advances in ink-jet technology, it has become possible to print high-quality images, such as photographs. In such cases, control of the amount of ink ejected from the ink-jet printer toward the paper and control of permeation of ink by treatment of the surface of paper are important factors. In order to improve the control of the ink ejection amount, for example, ink ejection devices with a finer structure have been developed. The control of ink permeation has been improved by special coatings applied to the surface of paper for high quality images. Consequently, special-purpose paper for high quality images is used when a high quality image is printed, and plain paper is used for ordinary printing. Special-purpose paper is inevitably expensive because of its surface treatment. There are several grades in special-purpose paper depending on the extent of required image quality, and the price varies with the grade. As another type of printing media, transparent sheets for OHP are still used. As described above, various types of printer paper are used.

Since various types of paper are used, the setting of the printer parameters settings must be changed according to the type of paper. In the case in which a user changes a setting manually, if the user makes an error in selecting the type of paper or if the user fails to operate the paper setting properly, there is a possibility that simple characters are printed on an expensive special-purpose sheet for high quality images, thus wasting the sheet.

Currently, there is an increasing demand for means and apparatuses which sense the type of paper.

In a conventional apparatus for sensing the type of paper, which is built into commercially available ink-jet printers, the surface of a sheet is irradiated with light by a light-emitting element, and reflected light and scattered light are detected by a photo-detector. When the surface of the sheet is irradiated with a specific ray of light, reflected light and scattered light differ depending on the glossiness of the surface of the sheet and the surface roughness. The above-mentioned apparatus senses the type of paper using this principle.

However, in the apparatus described above, since the light emitting element and photo-detector are expensive, the apparatus itself becomes expensive. In order to enhance sensing accuracy, a light emitting element which emits short-wavelength light (e.g., blue light) and a photo-detector which detects such light are used. In such a case, the apparatus becomes even more expensive.

SUMMARY OF THE INVENTION

It is an object of the present invention to provide a lower cost material sensing apparatus and a material sensing method.

In one aspect of the present invention, a material sensing apparatus includes a heat source which heats at least a first portion of an object, a temperature sensor which measures the temperature of a second portion of the object, a memory element which stores data on the relationship between temperature and type of object, and a determination element which determines the type of the object based on the measurement result of the temperature sensor and the data in the memory element. The temperature sensor measures the temperature of the second portion of the object at a predetermined distance from the first portion of the object heated by the heat source.

In another aspect of the present invention, a material sensing method includes the steps of heating at least a first portion of an object by a heat source, measuring the temperature of a second portion of the object at a predetermined distance from the heated first portion to generate a measurement result, and determining the type of the object based on the measurement result and data in a memory element.

In yet another aspect of the present invention, the material sensing apparatus is provided with a second temperature sensor which measures a temperature of the object at a third portion that is different from the second portion.

In still yet another aspect of the present invention, the heat source is the second temperature sensor and the second temperature sensor generates frictional heat by being slid over the object.

In still yet another aspect of the present invention, there is provided an image forming device which comprises any of the above-described material sensing apparatus together with an image forming unit for forming an image on the object.

Further objects, features and advantages of the present invention will become apparent from the following description of the preferred embodiments with reference to the attached drawings.

DESCRIPTION OF THE PREFERRED EMBODIMENTS

The embodiments of the present invention will be described with reference to FIGS. 1 to 6 and FIGS. 7A to 7C.

Figure 1:
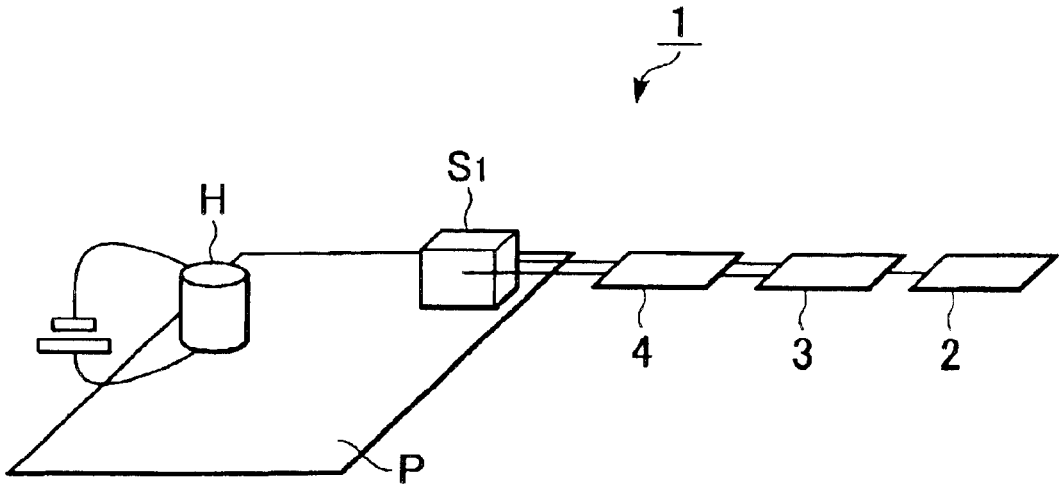
FIG. 1 is a schematic diagram showing a material sensing apparatus in accordance with the present invention.

In an embodiment of the present invention, as shown in FIG. 1, a material sensing apparatus 1 includes a heat source H which heats at least a portion of an object P, a first temperature sensor $S_1$ which measures the temperature (thermal conductivity characteristics) of the object P, a memory element 2 which stores data on the relationship between temperature and type of object P, and a determination element 3 which determines the type of the object P based on the measurement result of the first temperature sensor $S_1$ and the data in the memory element 2. Reference numeral 4 represents a measuring element which includes an ammeter or voltmeter and which converts an output from the sensor $S_1$ into an electric signal (voltage or current).

The sensing apparatus described above may include the memory element and the determination element directly or indirectly within the sensing apparatus (or an image-forming unit including the sensing apparatus). Herein, "include indirectly" means that the memory element and the determination element are provided in a computer device connected to the image-forming unit through a cable or the like. In such a case, the material sensing apparatus includes only the heat source, the sensor, and signal output means for outputting a signal from the sensor. Based on the output signal, the memory element and the determination element in the externally connected computer determine the material of the object and transmit a determination signal back to the image-forming unit provided with the material sensing apparatus. The image-forming unit receives the determination signal, and using the signal, various image-forming conditions, transporting conditions, etc., are appropriately set. The image-forming unit may be a copy machine, printer, facsimile machine, or the like.

That is, the material sensing apparatus may include a heat source which heats at least a portion of an object, a first temperature sensor which measures the temperature of the object, and means for outputting a signal from the first temperature sensor.

The first temperature sensor $S_1$ is positioned to measure a portion of the object at a predetermined distance from the portion heated by the heat source H.

Figure 2:
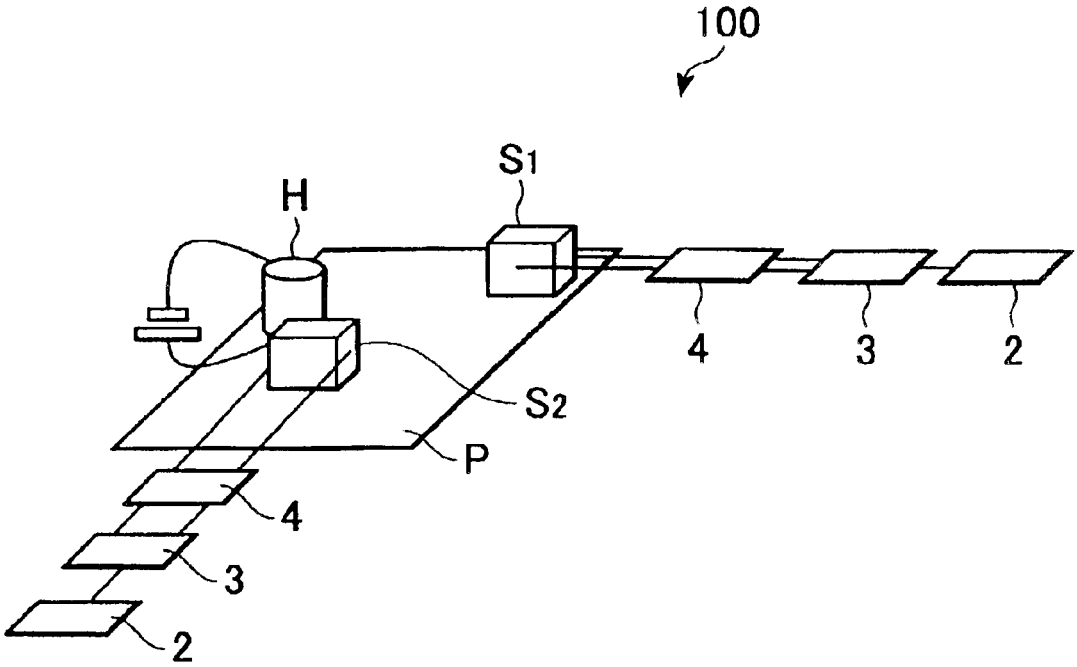
FIG. 2 is a schematic diagram showing another material sensing apparatus in accordance with the present invention.
Figure 3:
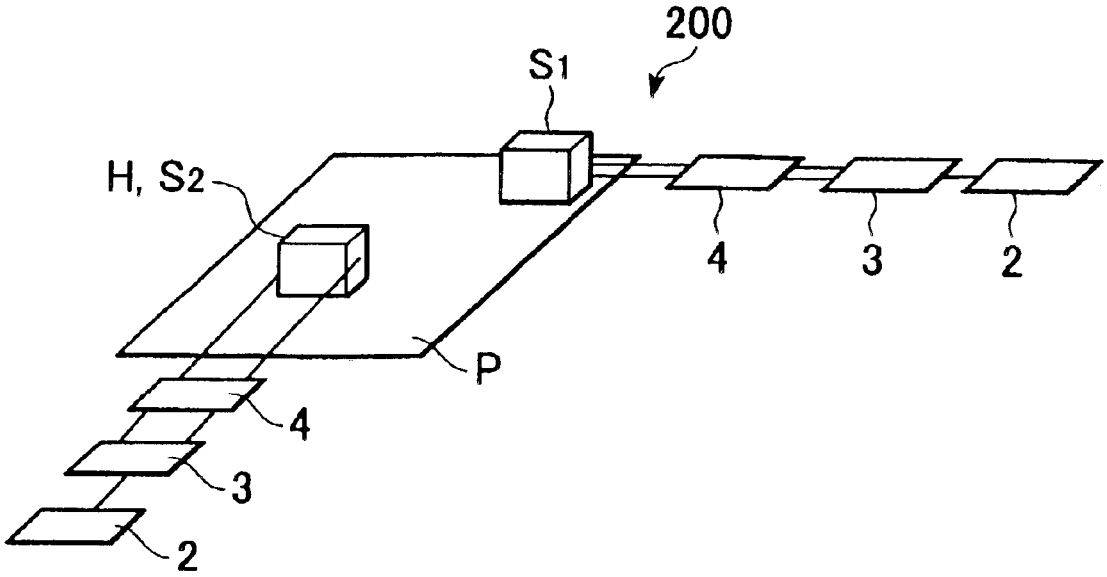
FIG. 3 is a schematic diagram showing another material sensing apparatus in accordance with the present invention.

In addition to the first temperature sensor $S_1$, a second temperature sensor may be used. In a material sensing apparatus 100 shown in FIG. 2, a second temperature sensor $S_2$ is positioned to measure the temperature of a portion of the object that is different from the portion of which temperature is measured by the first temperature sensor $S_1$. In such a case, by comparing the measurement result of the first temperature sensor $S_1$ with the measurement result of the second temperature sensor $S_2$, thermal conductivity characteristics of the object P can be obtained more accurately. With respect to the second temperature sensor $S_2$, the temperature (sheet temperature) of a portion near the portion heated by the heat source H may be measured by placing the second temperature sensor $S_2$ in the vicinity of the heat source H, as shown in FIG. 2. Alternatively, the temperature (sheet temperature) of the portion heated by the heat source H may be measured or the temperature of the inside of the heat source may be measured. In any case, by comparing the measurement result of the first temperature sensor $S_1$ with the measurement result of the second temperature sensor $S_2$, the material of the object can be sensed more accurately. FIG. 3 shows a material sensing apparatus 200 in which the temperature of the inside of the heat source is measured and used as described above, and the heat source H also functions as the second temperature sensor $S_2$. Instead of such a construction, the second temperature sensor may be built in the heat source as will be described in detail below.

Examples of the heat source H used include a heat source which generates heat by electricity (e.g., an electric heater) and a heat source which uses frictional heat (e.g., a heat source which generates heat by being rubbed over the surface of the object P). In the present invention, the timing for start/end of heating of the object P by the heat source H must be controlled accurately. In order to control the timing, for example, heating is started by bringing the heat source H which has been heated to a predetermined temperature into contact with the object P and heating is ended by removing the heat source H from the object P. Alternatively, the heat source H in an unheated state is brought into contact with the object P, and Joule heat or frictional heat is produced by electrification or sliding.

Figure 4:
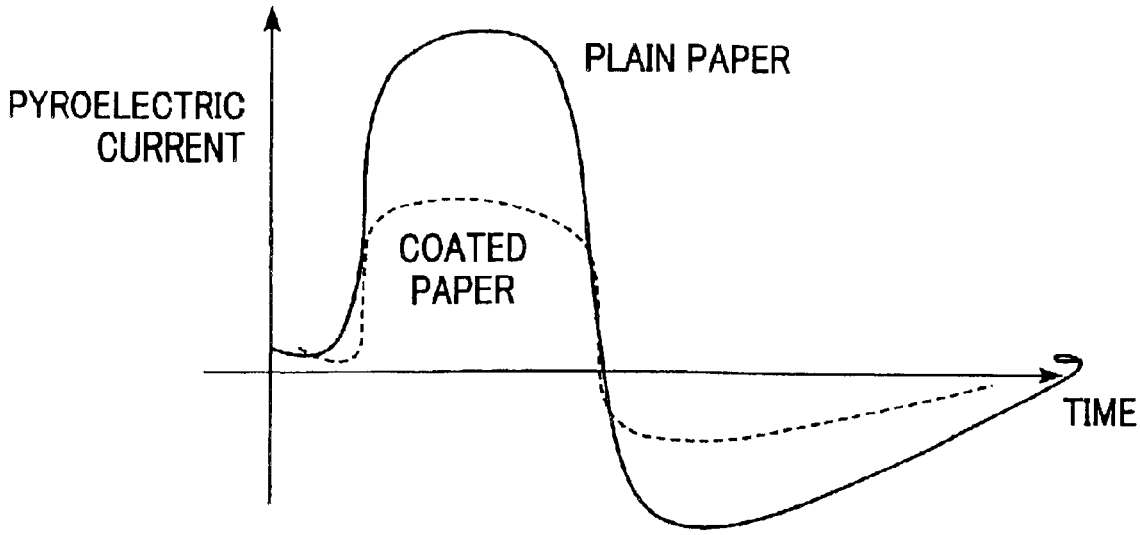
FIG. 4 is a graph showing a response profile of a temperature sensor.

As each of the first and second temperature sensors $S_1$ and $S_2$, a pyroelectric element, thermocouple, resistance thermometer, or the like may be used. When a pyroelectric element, thermocouple, resistance thermometer, or the like is used as the second temperature sensor $S_2$, it may also be used as the heat source H by sliding it over the surface of the object P to produce frictional heat (refer to FIG. 3). In such a case, the second temperature sensor $S_2$ measures frictional heat and also functions as the heat source H. The profile of frictional heat monitored by the second temperature sensor $S_2$ differs depending on the friction coefficient, heat capacity, and thermal conductivity of the surface of the object P. FIG. 4 is a graph showing a measurement profile when a pyroelectric element is used as the second temperature sensor $S_2$ which also acts as a heat source. As is evident from the graph, coated paper with a smooth surface and a small friction coefficient and plain paper with a relatively rough surface have different frictional heat profiles. Therefore, the measurement profiles can also be used as the data for determining the material of the object.

When a resistance thermometer is used as the temperature sensor, a power supply must be provided.

Figure 5:
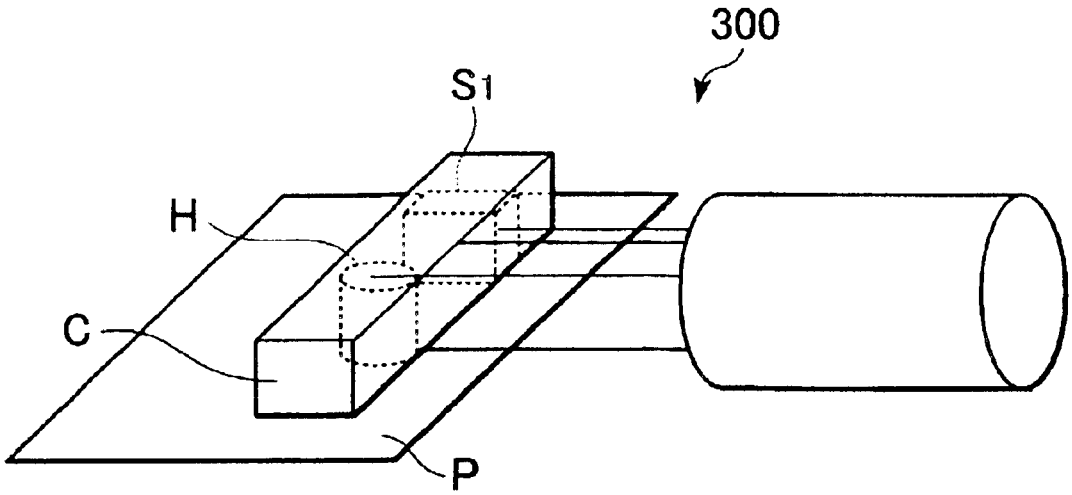
FIG. 5 is a schematic diagram showing another material sensing apparatus in accordance with the present invention.
Figure 6:
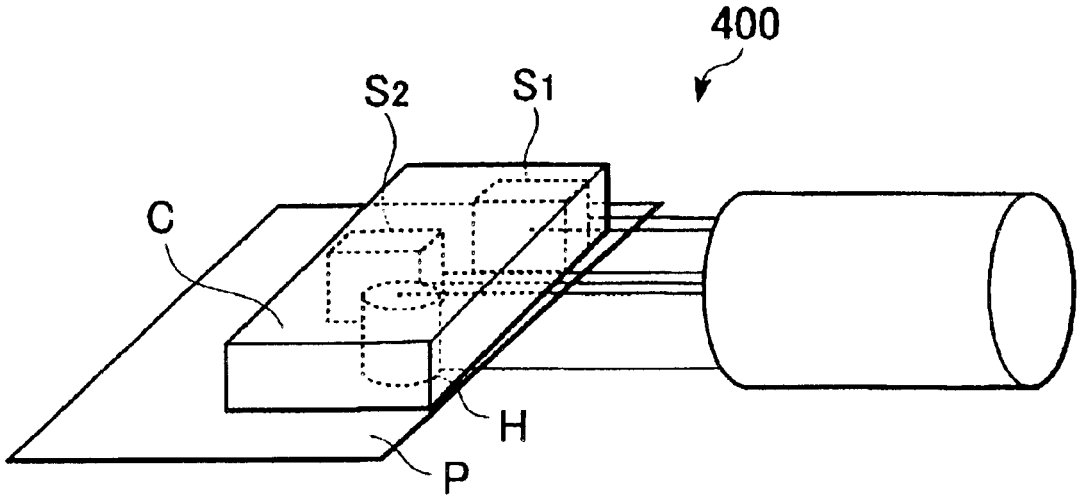
FIG. 6 is a schematic diagram showing another material sensing apparatus in accordance with the present invention.

The heat source H and the first temperature sensor $S_1$ shown in FIG. 1 may be held by an element (e.g., case) C to produce a unit as featured in material sensing apparatus 300 shown in FIG. 5. Similarly, the heat source H and the first and second temperature sensors $S_1$ and $S_2$ shown in FIG. 2 may be held by the element (e.g., case) C to produce a unit as featured in material sensing apparatus 400 in FIG. 6. Use of the element C allows a predetermined distance to be maintained between the heat source H and each of the sensors $S_1$ and $S_2$, and satisfactory measurement reproducibility is obtained. Wiring, etc., can also be performed simultaneously, lines can be handled easily, and measures to suppress external noise, etc., can be taken simultaneously.

As the object P, for example, paper is used.

A material sensing method in the present invention will be described below.

A material sensing method of the present invention includes the steps of heating at least a portion of an object P by a heat source H, measuring the temperature of a portion of the object P at a predetermined distance from the heated portion by a first temperature sensor $S_1$, and using determination element 3 to determine the type of object P based on the measurement result of the first temperature sensor $S_1$ and data in a memory element 2.

The determination step may be performed by a computer externally connected to the material sensing apparatus. In that case, the material sensing apparatus includes the heat source, the sensor, and signal output means for outputting a signal from the sensor. Based on the output signal, the memory element and the determination element in the externally connected computer determine the type of material and transmit a determination signal back to an image-forming unit provided with the sensing apparatus. The image-forming unit receives the determination signal, and using the signal, sets various image-forming conditions, transporting conditions, etc.

Additionally, the first temperature sensor $S_1$ may be designed so as to measure a change in temperature over time from the moment heating starts.

Figure 7A:
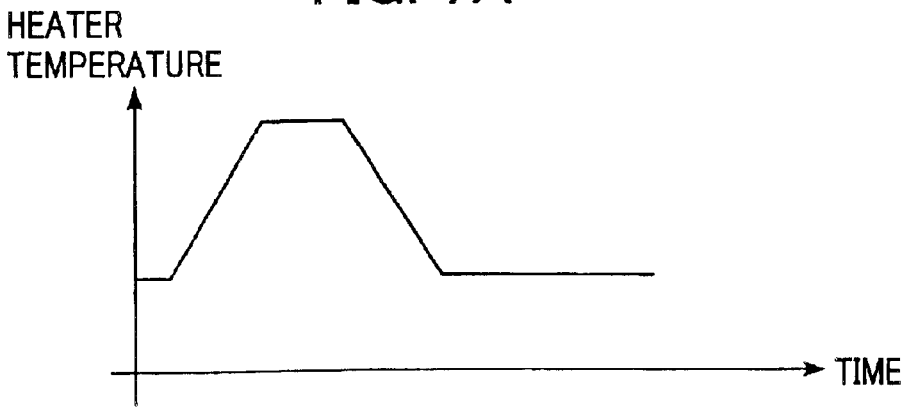
FIGS. 7A to 7C are graphs showing response profiles of temperature sensors.
Figure 7B:
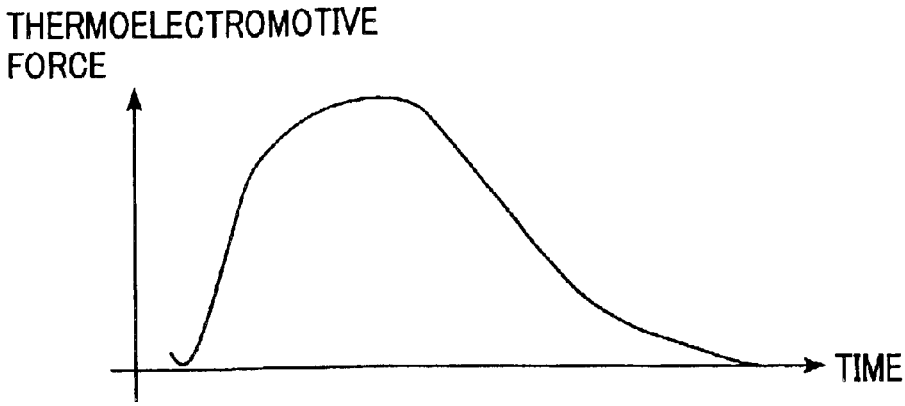
Figure 7C:
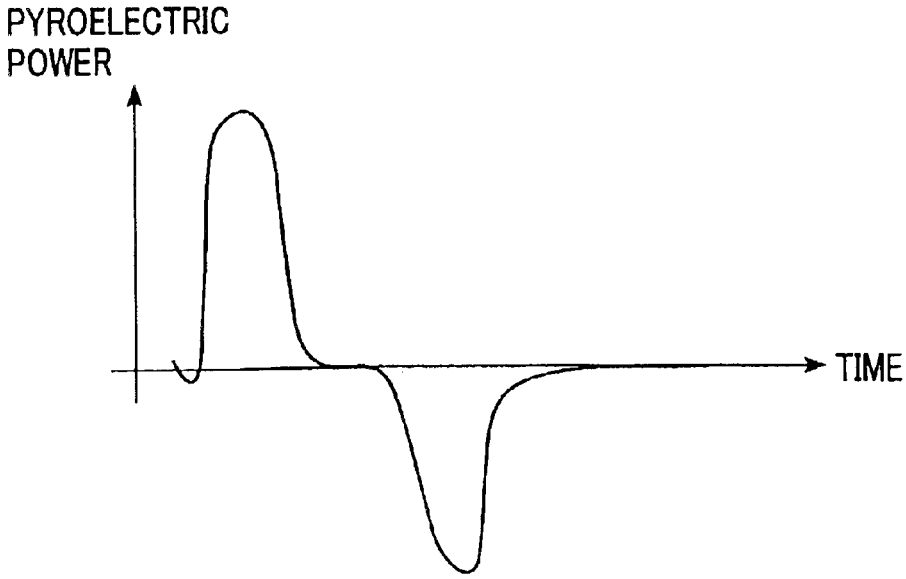

For example, by turning on and off the heat source H, a temperature history shown in FIG. 7A is applied to a portion (heating point) of the object P. When the first temperature sensor $S_1$ is a thermocouple or resistance thermometer, the output of the sensor $S_1$ is expressed as the curve shown in FIG. 7B (i.e., the output corresponds to the change in temperature over time). When the first temperature sensor $S_1$ is a pyroelectric element, the output of the sensor $S_1$ is expressed as the curve shown in FIG. 7C (i.e., the output corresponds to the change in time differential of temperature over time).

As described above, when temperature is measured by the first temperature sensor $S_1$, temperature may be measured by the second temperature sensor $S_2$ at a portion of the object P that is different from the portion at which temperature is measured by the first temperature sensor $S_1$.

In accordance with the present invention, since the apparatus uses heat sensing elements that are less expensive than light-emitting elements and photo-detectors, the apparatus itself can be fabricated inexpensively. Additionally, based on the determination of the material of the object P (e.g., type of paper) in accordance with the present invention, it is possible to change the amount of ink ejection in a printer or to change the fixing conditions (temperature, etc.) of a toner used in a copy machine.

EXAMPLES

The present invention will be described in more details based on Examples below.

Example 1

Example 1 of the present invention will be described with reference to FIG. 1.

In this example, a material sensing apparatus 1 was placed in a sheet stacker in order to determine the type of paper (object). The material sensing apparatus 1 was placed so as to be in contact with the surface of the uppermost sheet out of the sheets of paper set in the sheet stacker. A heater resistor was used as the heat source H, and a thermocouple was used as the first temperature sensor $S_1$. The size of the part in contact with the surface of the sheet in each of the heat source H and the temperature sensor $S_1$ was several hundred micrometers to several millimeters in diameter. The distance between the portion heated by the heat source H and the portion of which temperature was measured by the sensor $S_1$ was set at a predetermined value in the range of several millimeters to several centimeters. A voltmeter was used as the measuring element 4.

Figure 8A:
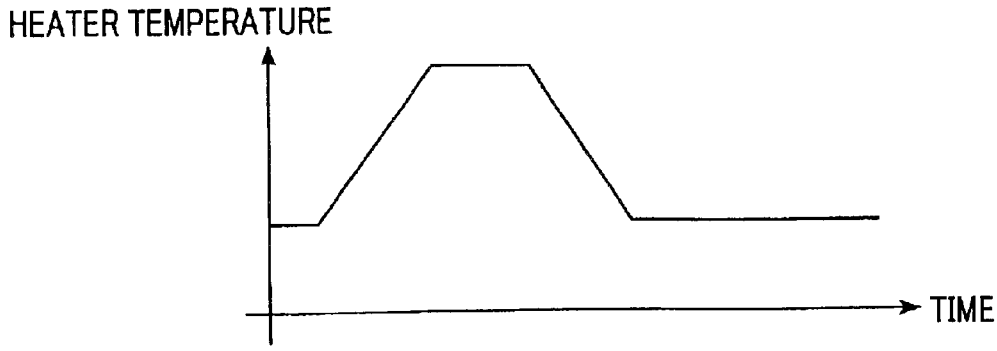
FIGS. 8A to 8C are graphs showing response profiles of temperature sensors.

First, the heat source H and the sensor $S_1$ were brought into contact with paper P, the heat source H was then turned on, and after a predetermined period of time, the heat source H was turned off (refer to FIG. 8A). At that time, the temperature sensor $S_1$ exhibited a response profile shown in FIG. 8B. Based on the response profile, arithmetic processing and reference processing were performed by the determination element (processing circuit) 3 to determine the type of paper. When coated paper and plain paper were tested, since there was a difference in thermal conductivity characteristics between the two types of paper, determination was enabled. In general, coated paper has a higher surface thermal conductivity than that of plain paper.

Example 2

In this example, the material sensing apparatus 100 shown in FIG. 2 was fabricated. That is, in addition to a first temperature sensor $S_1$, a second temperature sensor $S_2$ was placed in the vicinity of a heat source H. A thermocouple was used as each of the sensors $S_1$ and $S_2$. Other than that, the same construction and operation as those in Example 1 were used.

Figure 8B:
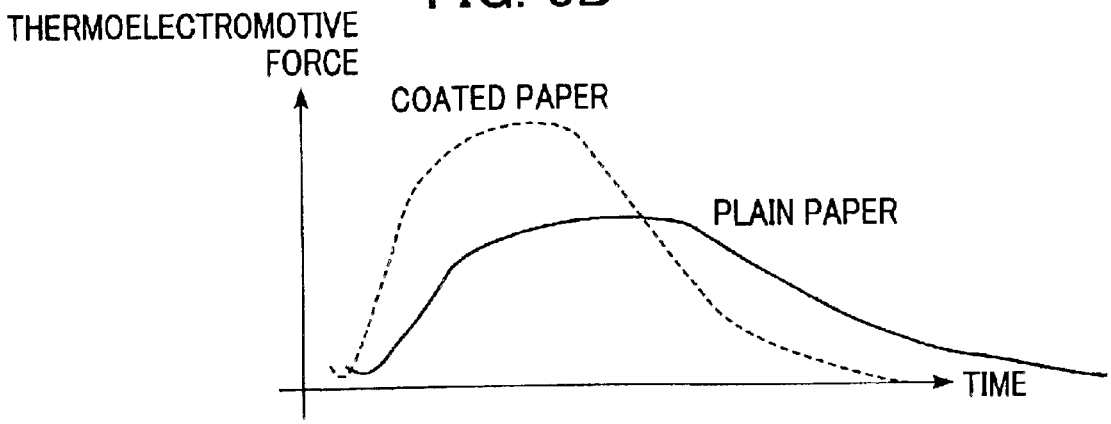
Figure 8C:
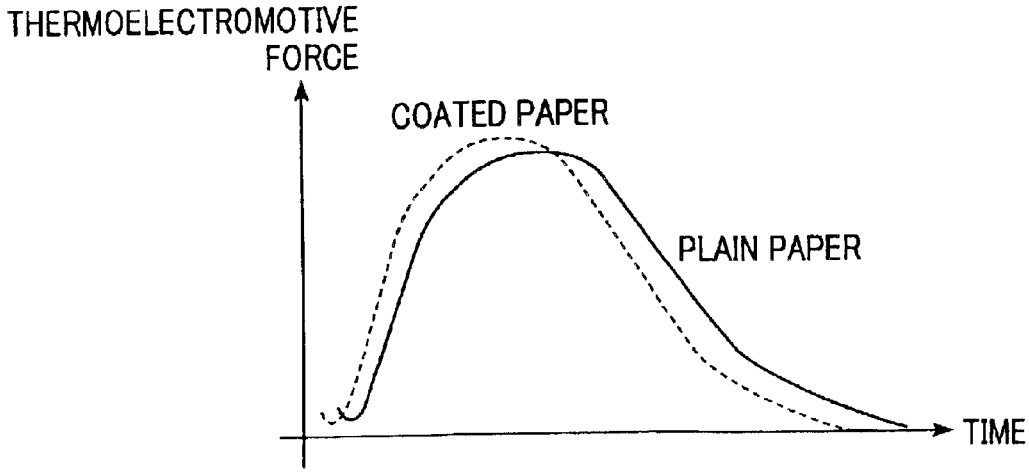

When the temperature history of the heat source H was set according to the curve shown in FIG. 8A, the first temperature sensor $S_1$ exhibited a response profile shown in FIG. 8B and the second temperature sensor $S_2$ exhibited a response profile shown in FIG. 8C. When plain paper and coated paper were compared with each other, their thermal conductivity differs. The coated paper has a surface coated with an inorganic substance giving it satisfactory surface thermal conductivity. As a result, there is only a small difference in response between temperature sensors of varying distance from the heat source H. On the other hand, the surface of fibrous plain paper has a lower density as compared to the surface of coated paper, and the thermal conductivity of fibrous plain paper is less than that of coated paper. Consequently, as the distance from the sensor to the heat source H increases, responsiveness decreases. The difference in response profile according to types of paper was preliminarily inputted in the determination element 3, and it is possible to determine the type of paper for each sheet based on the difference in thermal conductivity characteristics.

Example 3

Figure 9A:
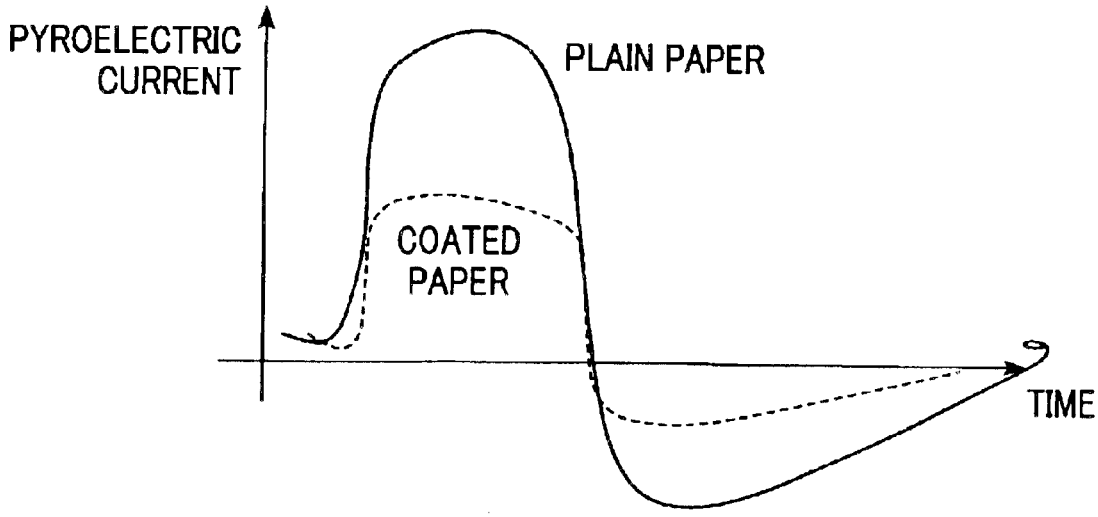
FIGS. 9A and 9B are graphs showing response profiles of temperature sensors.
Figure 9B:
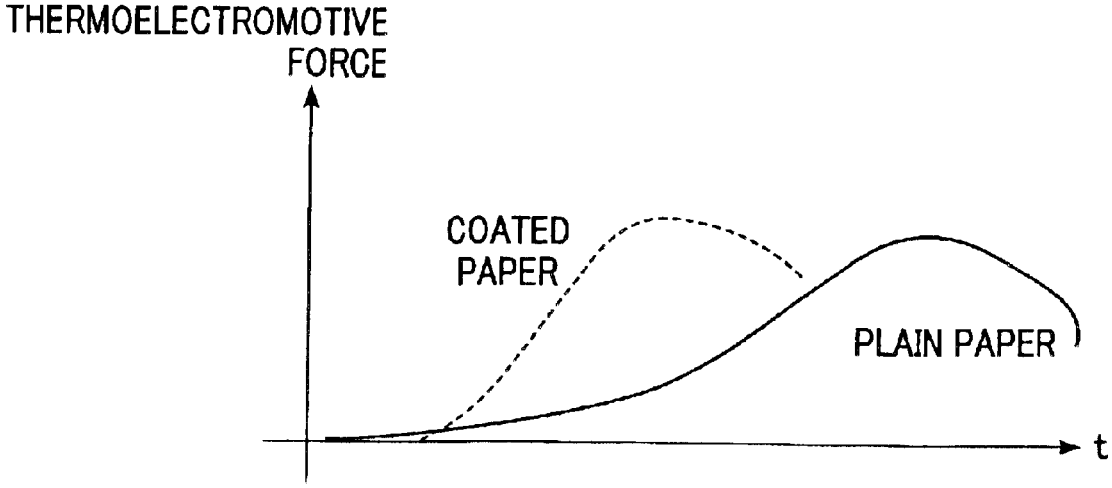

In this example, a material sensing apparatus 200 shown in FIG. 3 was fabricated. That is, a pyroelectric element was used as the second temperature sensor $S_2$, and the second temperature sensor $S_2$ is slid in a reciprocating manner over the surface of the sheet causing it to also function as the heat source H. At that time, the second temperature sensor $S_2$ exhibits the response profile shown in FIG. 9A and the first temperature sensor $S_1$ exhibits the response profile shown in FIG. 9B. The surface of coated paper was smooth. In contrast, the surface of plain paper was rougher than that of coated paper. Therefore, plain paper had a larger friction coefficient than the coated paper and a larger amount of frictional heat was generated when the sensor was slid over the surface of the plain paper under a normal load than was generated when slid over the surface of the coated paper under that same normal load. Consequently, as shown in FIG. 9A, the response of the second temperature sensor $S_2$ differs depending on the type of paper.

The measurement results of the first temperature sensor $S_1$ and the second temperature sensor $S_2$ were processed by the determination element 3 to determine the type of paper. When coated paper and plain paper were tested, since there was a difference in thermal conductivity characteristics and the surface friction coefficient between the two types of paper, the determination was enabled.

As described above, in accordance with the present invention, since elements which are less expensive than light-emitting elements and photo-detectors are used, the fabrication cost of the apparatus itself can be reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A material sensing apparatus comprising:

a heat source which heats at least a first portion of an object;

a temperature sensor which measures a temperature of the object at a second portion of the object and outputs a measurement result;

a memory element which stores data on the relationship between temperature and type of object; and a determination element which determines a type of the object based on the measurement result of the temperature sensor and the data in the memory element, wherein the temperature sensor measures the temperature of the second portion of the object at a predetermined distance from the first portion of the object heated by said heat source, wherein said temperature sensor is a first temperature sensor and, further comprising a second temperature sensor which measures a temperature of the object at a third portion that is different from the second portion, wherein said second temperature sensor comprises one of a pyroelectric element, a thermocouple, and a resistor, and wherein said heat source is said second temperature sensor, and wherein said second temperature sensor generates frictional heat by being slid over the object.

2. A material sensing apparatus comprising:

a heat source which heats at least a first portion of an object;

a temperature sensor which measures a temperature of the object at a second portion of the object and outputs a measurement result;

a memory element which stores data on the relationship between temperature and type of object; and a determination element which determines a type of the object based on the measurement result of the temperature sensor and the data in the memory element, wherein the temperature sensor measures the temperature of the second portion of the object at a predetermined distance from the first portion of the object heated by said heat source, wherein said temperature sensor is a first temperature sensor and, further comprising a second temperature sensor which measures a temperature of the object at a third portion that is different from the second portion, wherein said first temperature sensor comprises one of a pyroelectric element, a thermocouple, and a resistor, wherein said second temperature sensor comprises one of a pyroelectric element, a thermocouple, and a resistor, and wherein said heat source is said second temperature sensor, and wherein said second temperature sensor generates frictional heat by being slid over the object.

* * * * *

UNITED STATES PATENT AND TRADEMARK OFFICE

CERTIFICATE OF CORRECTION

PATENT NO. : 6,863,363 B2
DATED : March 8, 2005
INVENTOR(S) : Hisoto Yabuta

It is certified that error appears in the above-identified patent and that said Letters Patent is hereby corrected as shown below:

Column 5,
Line 35, “details” should read -- detail --.

Column 6,
Line 30, “in” should read -- into --.

Signed and Sealed this

Twelfth Day of July, 2005

JON W. DUDAS
*Director of the United States Patent and Trademark Office*